US007670305B2

(12) United States Patent
Zhadanov et al.

(10) Patent No.: US 7,670,305 B2
(45) Date of Patent: Mar. 2, 2010

(54) DEVICE FOR SHOWERING AND TURBO-ROTATIVE WATER TREATMENT

(76) Inventors: Sam Zhadanov, 2944 W. 5th St., Apt 20J, Brooklyn, NY (US) 11224; Eli Zhadanov, 2944 W. 5th St., Apt 20J, Brooklyn, NY (US) 11224

( * ) Notice: Subject to any disclaimer, the term of this patent is extended or adjusted under 35 U.S.C. 154(b) by 0 days.

(21) Appl. No.: 11/983,595

(22) Filed: Nov. 13, 2007

(65) Prior Publication Data

US 2009/0124946 A1 May 14, 2009

(51) Int. Cl.
*A61H 9/00* (2006.01)
*A47L 11/00* (2006.01)
*A46B 13/00* (2006.01)

(52) U.S. Cl. ..... 601/160; 15/29

(58) Field of Classification Search ..... 601/84, 601/88, 55, 105, 112, 114, 154, 155, 159, 601/160, 169; 239/436–438; 16/115; 15/24, 15/29, 144.4; 401/203, 289
See application file for complete search history.

(56) References Cited

U.S. PATENT DOCUMENTS 4,841,590 A * 6/1989 Terry et al. ..... 15/28
5,502,864 A * 4/1996 Sorenson ..... 15/230.11
6,021,539 A * 2/2000 Zhadanov et al. ..... 15/29
6,306,110 B1 * 10/2001 McElhannon ..... 601/160
6,338,170 B1 * 1/2002 De Simone ..... 4/606
6,355,009 B1 * 3/2002 Henkin et al. ..... 601/155
7,114,666 B2 * 10/2006 Luettgen et al. ..... 239/463
2003/0144615 A1 * 7/2003 Lin ..... 601/112
2006/0043214 A1 * 3/2006 Macan et al. ..... 239/222.11

* cited by examiner

*Primary Examiner*—Justine R Yu
*Assistant Examiner*—Kristen C Matter
(74) *Attorney, Agent, or Firm*—I. Zborovsky

(57) ABSTRACT

A device for showering has a housing and a rotatable massaging element arranged in the housing so that it is rotatable by water and capable of massaging with the simultaneous discharge of water. A rotary unit is located in the housing and is connected with the massaging element to be acted on by water so that the rotary unit rotates and rotates the massaging element. The rotary unit is composed of at least two rotors which are configured so that in a first mode of operation only one of the rotors rotates and provides rotation of the massaging element and issuance of water for showering, and in a second mode of operation both the rotor elements rotate to provide a turbo rotation of water.

7 Claims, 13 Drawing Sheets section B-B view A

DEVICE FOR SHOWERING AND TURBO-ROTATIVE WATER TREATMENT

BACKGROUND OF THE INVENTION

The present invention relates to devices for showering.

More particularly, it relates to devices for showering which are used in bathrooms and shower cabins for washing and massaging a user's body.

Devices for showering are known in the art. They perform various functions of spraying and pulsation, as well as a combination of these functions. Some devices of this type combine rotation and spraying, as disclosed for example in U.S. Pat. Nos. 4,480,922; 2,678,457; 5,007,127; 5,129,121; and 6,021,539. It is believed that the existing devices can be further improved, to combine showering and turbo-rotation water treatment.

SUMMARY OF THE INVENTION

It is an object of the present invention to provide a device for showering which is a further improvement of the existing devices.

In keeping with these objects and with others which will become apparent hereinafter, one feature of the present invention resides, briefly stated, in a device for showering, a housing; and a rotatable massaging element arranged rotatably in said housing and forms so that it is rotatable by water and capable of massaging the simultaneous discharge of water, and a rotary unit located in said housing and connected with said massaging element and also acted by water so that rotary unit rotates under an action of water and rotates said massaging element, said rotary unit being composed of at least two rotors which are configured so that in a first mode of operation only one of said rotors rotates and provides rotation of said massaging element and issuance of water for showering, and in a second mode of operation both said rotor elements rotate to provide a turbo rotation of water.

In accordance with the further important feature, a device has an axis of rotation and is rotatable about said axis, so that the rotary unit including an outside rotor located radially outwardly and an inside rotor located radially inwardly rotates about said axis.

When the new device is designed in accordance with the present invention, it provides operation in several different modes. In particular, it can operate as an outside shower, an inside showers with pulsation, an outside and an inside shower simultaneously, as a pulsating three jet stream, as an outside shower with the pulsating three jet stream, as a pulsation shower with a rotational water, and a pulsating three jet stream with the tool rotation of water.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 7B:
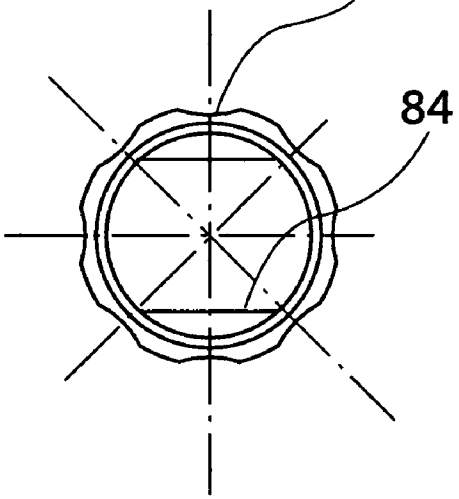
FIGS. 7*a* and 7*b* are views showing a longitudinal cross-section and an end view of a handle of the inventive device.
Figure 7A:
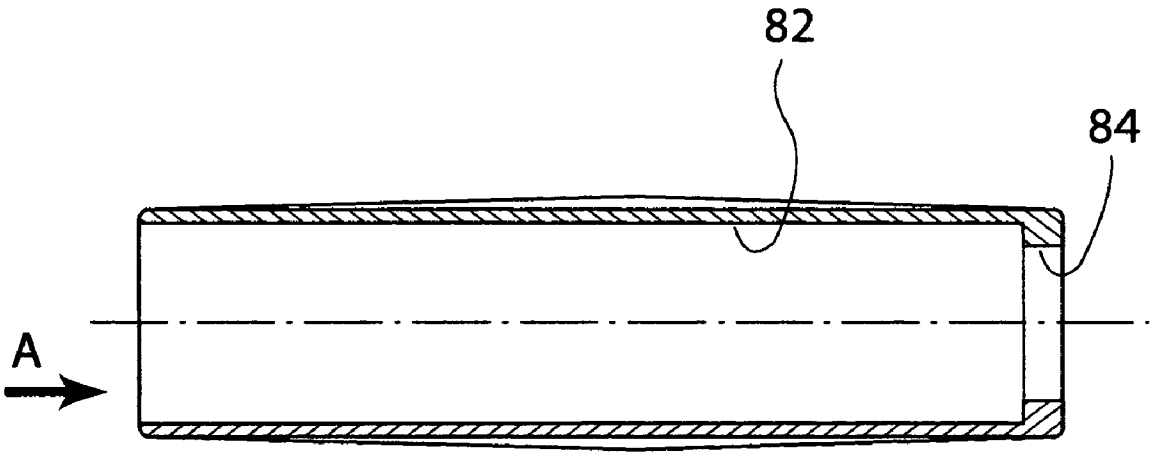
Figure 8B:
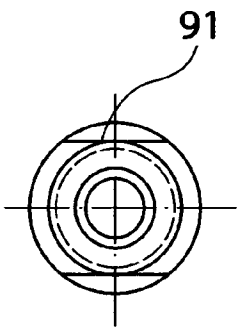
FIGS. 8*a*, 8*b* and 8*c* are views showing an extension element of the inventive device, its end view and its transverse cross-section.
Figure 8C:
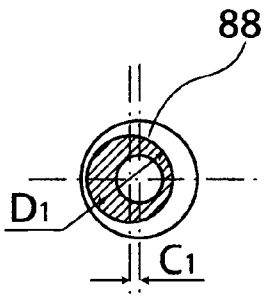
Figure 8A:
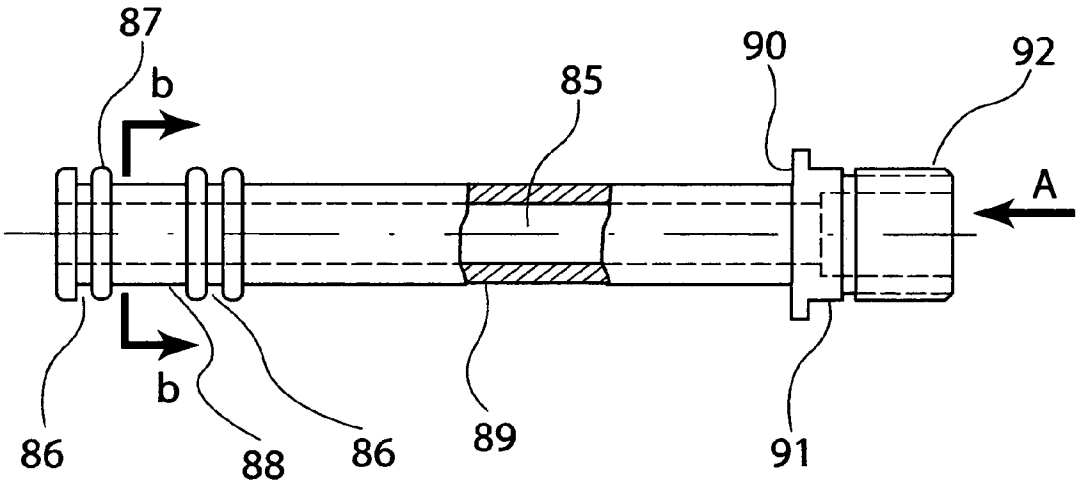
Figure 9:
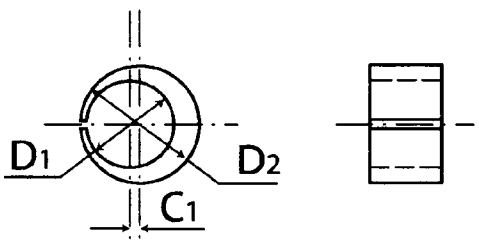
FIG. 9 shows a plan view and a side view of a concentric bushing.

A showering device in accordance with the present invention has a housing which is identified with reference numeral 1 with a holder 63, on which a handle 2 shown in FIG. 7 can slide. An extension element 3 slides inside the holder 63 as shown in FIG. 8 and has a groove 88 with a split springy insert 5 (FIG. 9) located eccentrically in it. The movement of the extension is limited by inserts 6 shown in FIG. 10, which are located in slots 71 of the housing 1.

The handle 2 is arranged on flats 91 of the extension element 3 and pressed against a flange 90 by a threaded ring 4. The extension has an end provided with a thread 92 for connection with a water supply system. Rubber rings 22 provide sealing of the extension with the housing.

Figure 2:
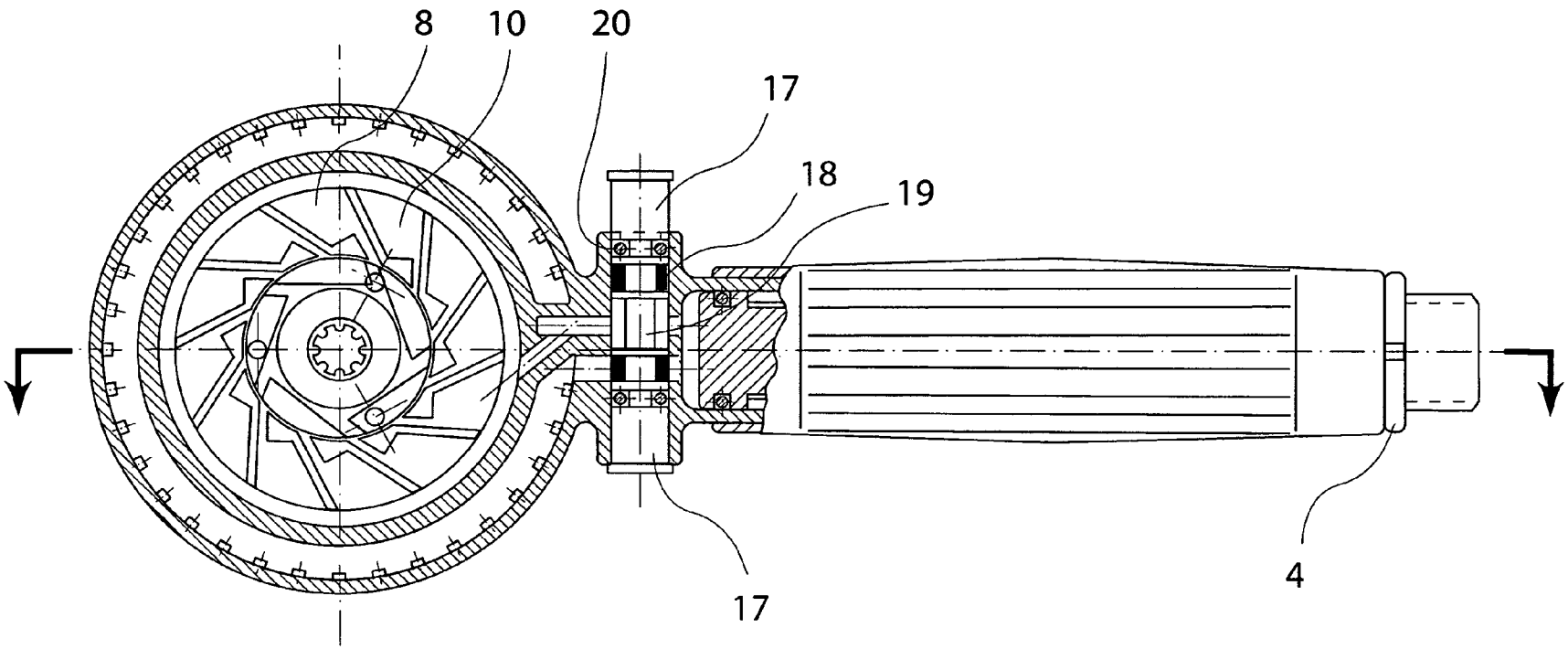
FIG. 2 is a section plan view of the inventive device, with a section along a rotor and a switch.
Figure 3:
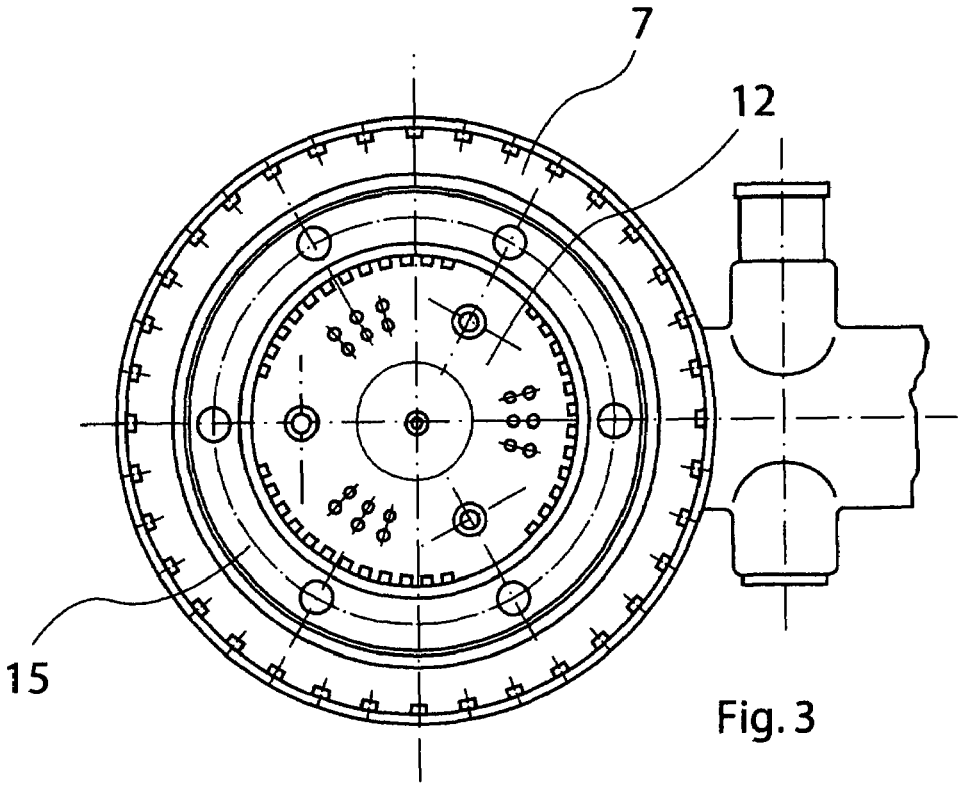
FIG. 3 is a plan view of a head of the inventive device.
Figure 4:
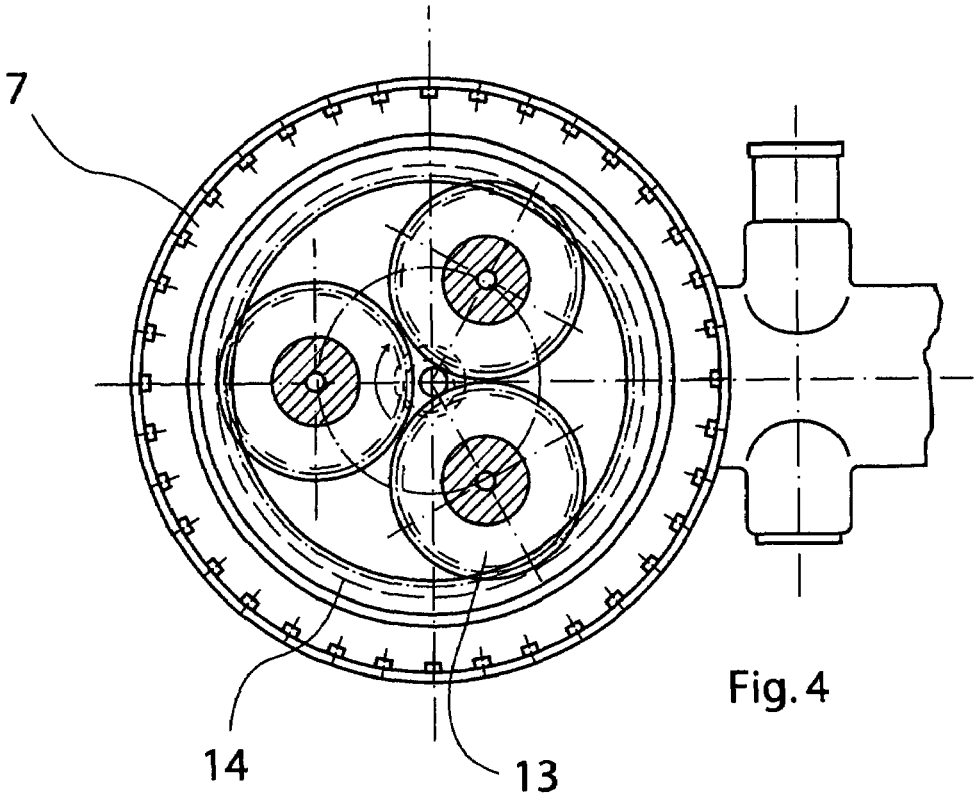
FIG. 4 is a view showing a section of the head with a rotary mechanism.
Figure 5:
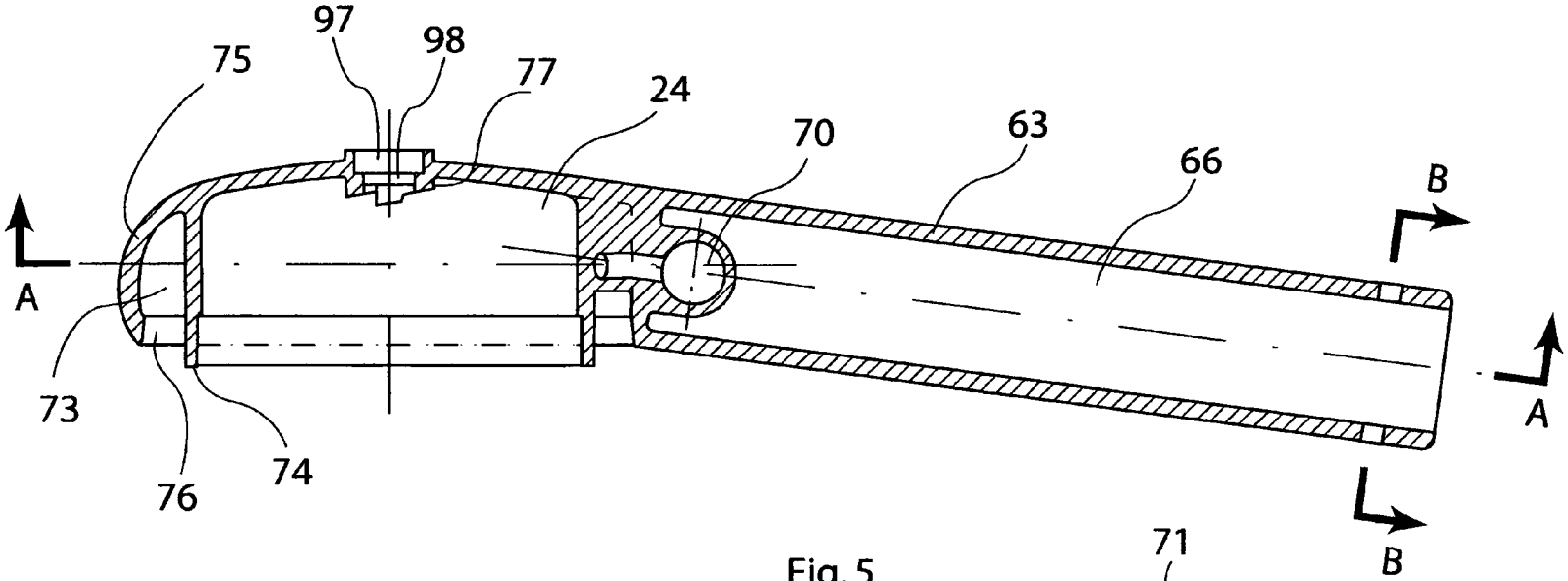
FIG. 5 is a view showing a longitudinal cross-section of a housing of the device.
Figure 5A:
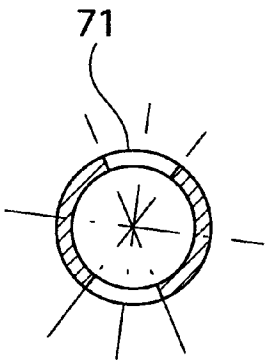
FIG. 5*a* is a view showing a transverse cross-section of the housing taken along the lines B-B.
Figure 10:
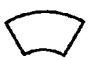
FIG. 10 is a view showing an insert of the inventive device.
Figure 15B:
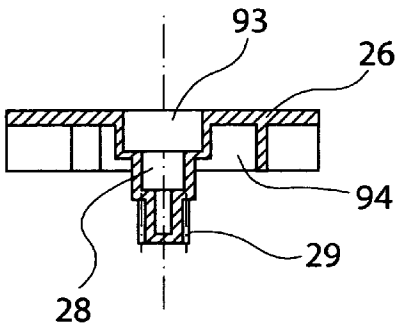
FIGS. 15*a* and 15*b* are a plan view and a cross-section of a rotor of the inventive device.
Figure 15A:
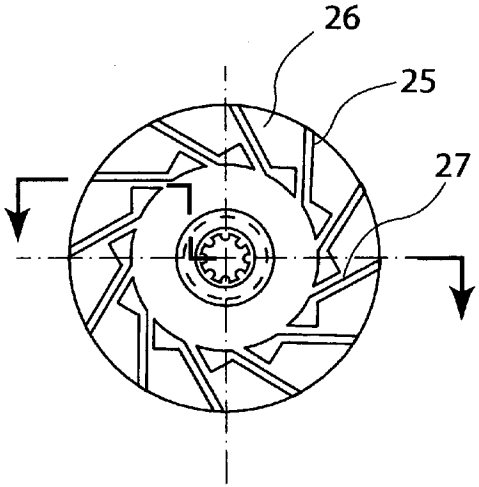
Figure 20:
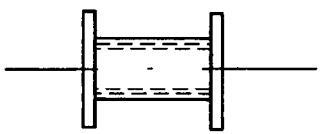
FIG. 20 is a view showing another part of switching button.

The device has a switching mechanism shown in FIG. 2 which includes two buttons 17 shown in FIG. 10, one spacer 19 shown in FIG. 20, two rubber seals 18 and two sealing rings 20. A rotor 8 shown in FIG. 15 is located in a central cavity 24 of the housing 1 as shown in FIG. 5.

Figure 22A:
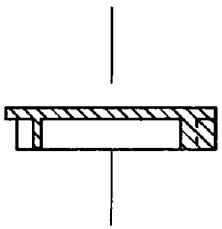
FIGS. 22*a* and 22*b* are views showing a cross-section and a plan view of an inside rocker.
Figure 22B:
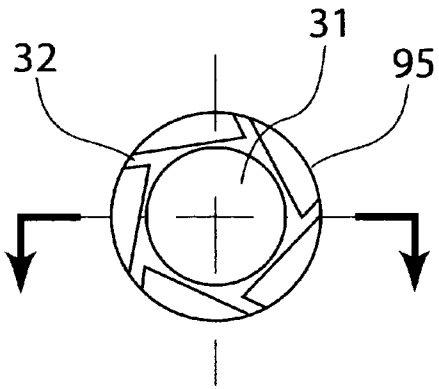

The rotor has inclined blades 25 which are located at an angle relative to an axis of rotation and mounted on a disk 26. In a lower part the blade is a gap-shaped opening 27, which is also arranged at an angle relative to the axis of rotation. The motor has an axis of rotation 28 with a pinion 29. With the upper part the roller has a cavity 93 which is configured for accommodation of a cam mechanism of a control system. A lower cavity 94 is provided for accommodation of an inside rotor which operates as an interrupter for providing a pulsation. The inside rotor shown in FIGS. 22*a* and 22*b* has a central opening 31, and blades 32 which are located at an angle to the axis of rotation and arranged on a disk 95. A rubber O-ring 96 is mounted on the axis of the rotor.

Figure 11B:
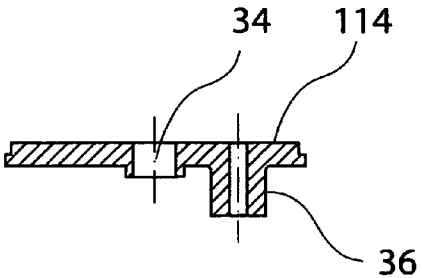
FIGS. 11*a* and 11*b* are a plan view and a cross-section of a cover of the inventive device.
Figure 11A:
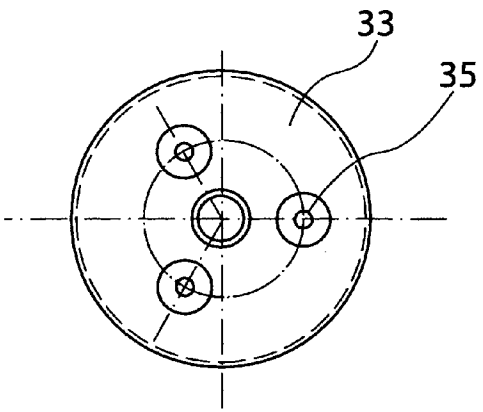
Figure 12:
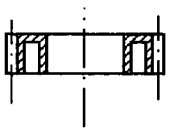
FIG. 12 is a view showing a cross-section of the gear of the inventive device.
Figure 13:
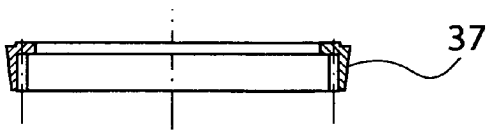
FIG. 13 is a view showing a cross-section of an internal gear of the inventive device.

The cavity 24 of the housing 1 is closed by a cover 9 shown in FIG. 11 and formed as a disc 33 with a central opening 34 and three openings 35 located inside axles 36. An axle of the rotor 28 extends through the opening 34 slidingly. Gears 13 shown in FIG. 12 are arranged on the axles 36 and engage with the pinion 29 of the rotor 8 and a gear with internal engagement 14 shown in FIG. 13. Its outer wall 37 has a cone for mounting of working instruments, for example a bristle brush.

Figure 14B:
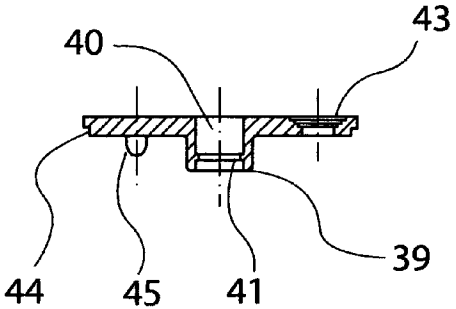
FIGS. 14*a* and 14*b* are a plan view and a cross-section of another cover of the inventive device.
Figure 14A:
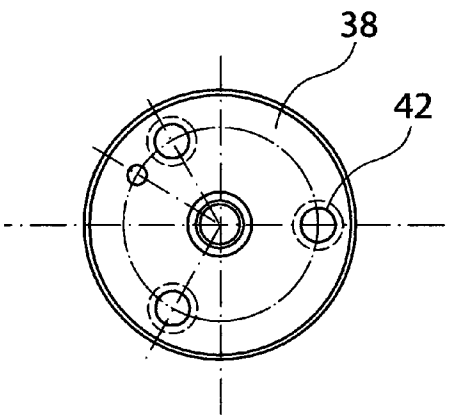

The pinions and gears form a planetary transmission operating as a reducer. The planetary transmission is covered from above by a cover 11 shown in FIG. 14 and welded or glued to the axles 36 of the element 9. The cover is formed as a disc 38 shown in FIGS. 14*a* and 14*b* has a projection 39 with an opening 40 and a ring-shaped lug 39 and a ring projection 41, three openings 42 with a groove 43 for mounting on the axles 36 and a groove 44 on the periphery of the disc, and a stop projection 45.

Figure 17B:
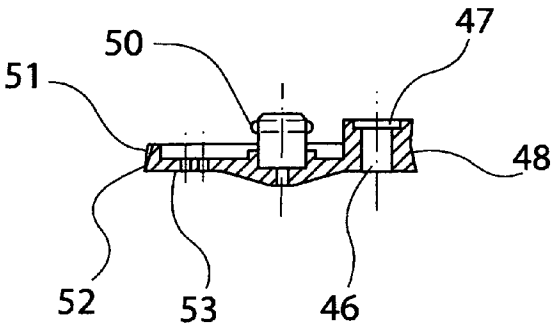
FIG. 17*a* is a plan view and FIG. 17*b* is a cross-section of a water distributing element of the inventive device.
Figure 17A:
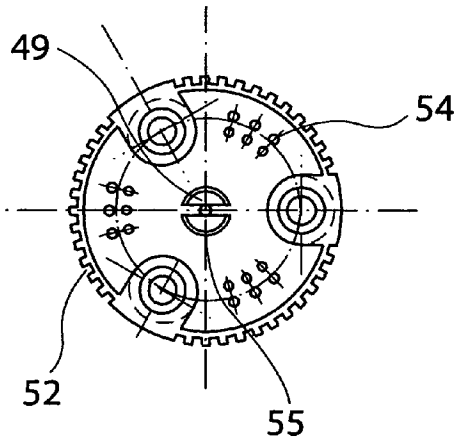

The water distributing element 12 shown in FIGS. 17*a* and 17*b* has three openings 46 with a groove 47 inside a lug 48. A split lug 49 with a side ring-shaped projection 50 is located in the center of the water distributing element. Conical slots 52 are provided on the periphery, on the conical wall 51. The lower wall 53 has sets of openings 54 and a draining opening 55. O-rings 23 are located in the grooves 47.

Figure 16B:
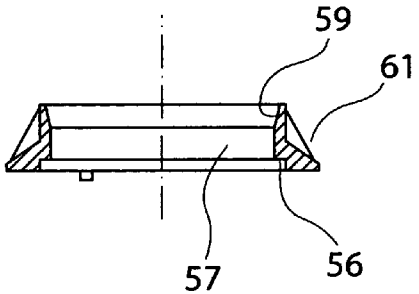
FIGS. 16*a* and 16*b* are a plan view and a cross-section of a ring of the inventive device.
Figure 16A:
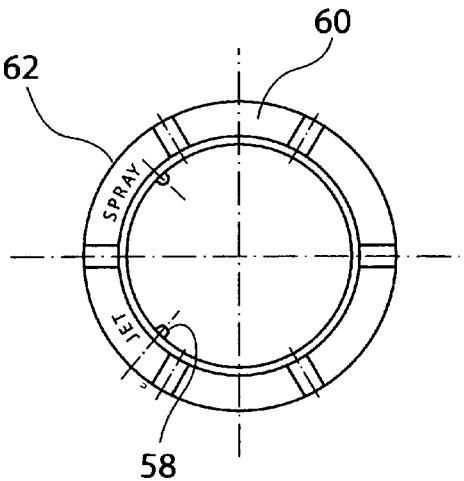

The water distributing element 12 is located inside a turnable ring 15 (FIG. 1) shown in FIG. 16, which has a groove 56 with a sealing ring 21, a central opening 57 with two stops 58 which fix a position of the water distributing element during mounting, along the side walls of the projections 48. The ring has a conical part 59 which, together with the conical wall 51, forms by the conical slots 52 shown in FIG. 17 a jet of a showering flow. The ring has a conical flange 60, spherical projections 61, a technical information 62. The ring forms a driving device during switching of a mode of operation. Fixing of the water distributing element 12 to the cover 9 is performed by snapping of the split lug 49 in the opening 40.

Figure 6:
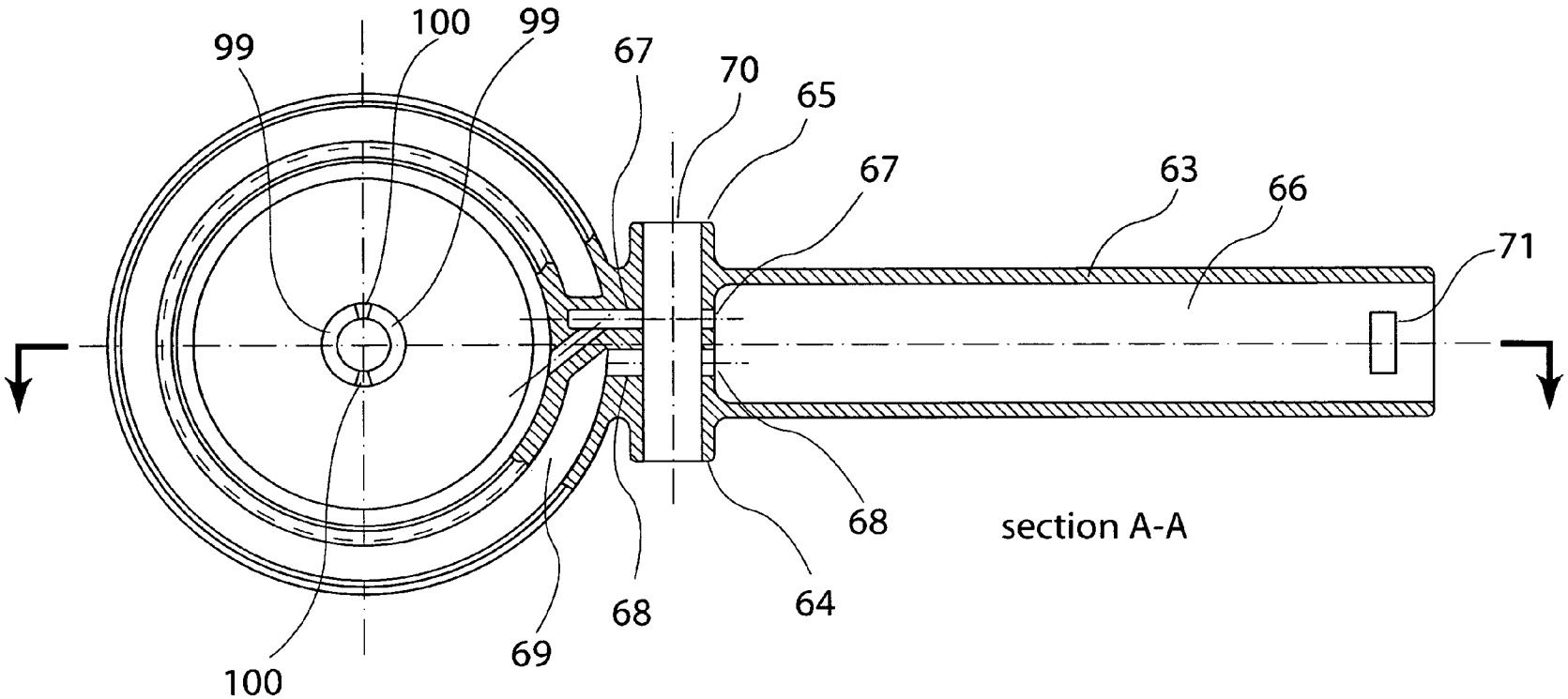
FIG. 6 is a view showing a longitudinal cross-section of the device in a plane which is perpendicular to a cross-sectional plane of FIG. 5.
Figure 21A:
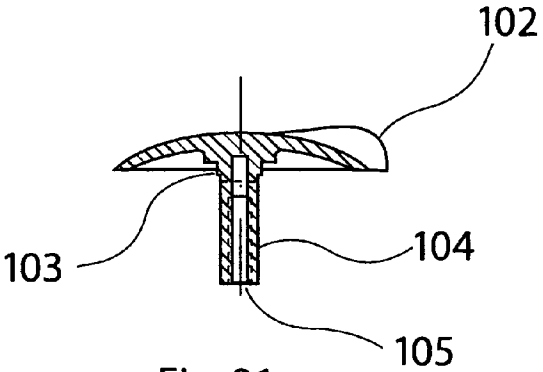
FIGS. 21*a* and 21*b* are views showing a round knob for controlling of the inventive device.
Figure 21B:
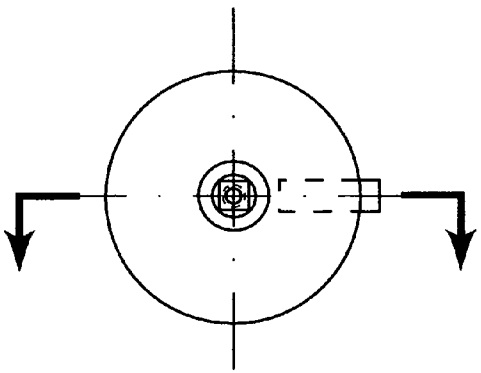

The housing 1 shown in FIGS. 5 and 6 is formed together with the holder 63 as a one piece element, having two hollow projections 64 and 65 and a set of openings including a central opening 66, distributing openings 67, 68, 69, openings of a control system 70, and structural openings 71. The main part of the housing has two receptacles 24 and 73. These receptacles are separated by a cylindrical wall 74. The wall has a conical part 76. The housing in its center has a hub 77. The outer part has openings 97 and 98, the inner part has two screw shape surfaces 99 which form a cam track and in two stops 100. In the housing shown in FIG. 1, a knob 101 is arranged with an arm 102 as shown in detail in FIGS. 21*a* and 21*b*. The knob has a cylindrical part of a road 103 and a square part 104, inside there is a threaded opening 105.

Figure 23A:
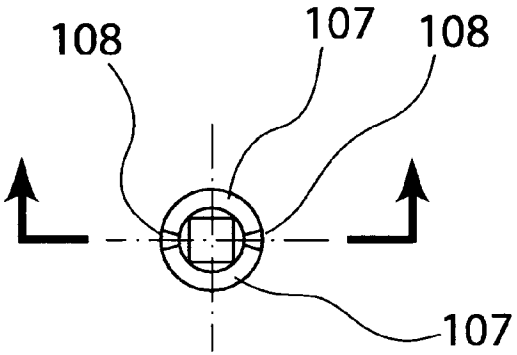
FIGS. 23*a* and 23*b* are plan view and a cross-section of a cam-bushing unit of the inventive device.
Figure 23B:
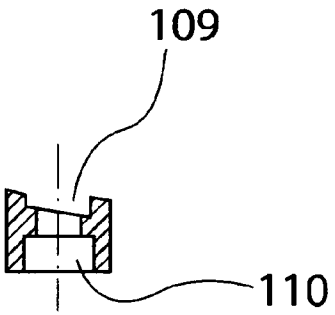

A cam bushing 106 is arranged slidably on the square part as shown in FIGS. 23*a* and 23*b*. The cam has screw shape surfaces forming a cam track 107 and ending in two stops 108, which are similar to those located on the housing 1. In the center the cam bushing has a square opening 109 and a cylindrical opening 110, in which a spring 111 is arranged and fixed by screw 112.

Figure 18B:
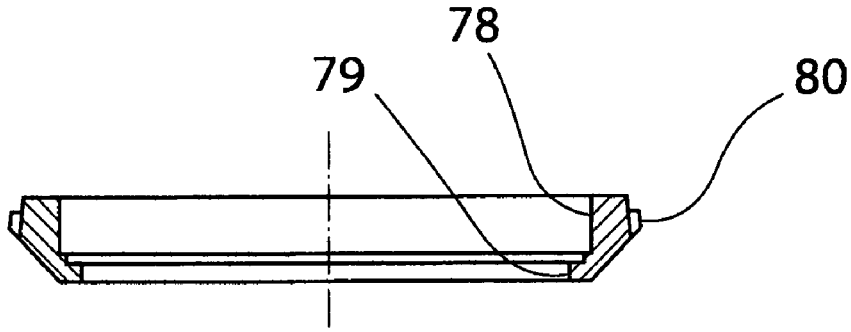
FIGS. 18*a* and 18*b* are a plan view and a cross-section of a perforator element of the inventive device.
Figure 18A:
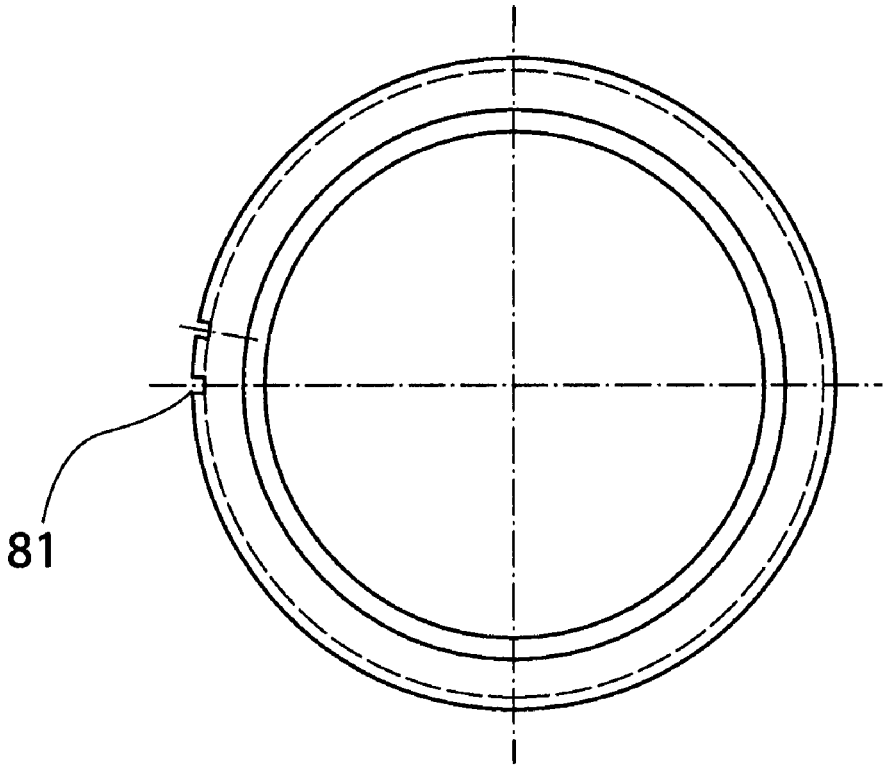

The receptacle 73 is closed by a perforator element 7 (FIG. 1) shown in FIGS. 18*a* and 18*b*. The perforator element is formed as a ring having a cylindrical part 78 with an inner flange 79. The outer wall 80 has an inclination, and grooves 81 which are also arranged with an inclination are provided on it.

The perforator element 7 is welded to the wall 74 of the housing 1 by the flange 79. The combination of the conical grooves 81 with the conical wall 76 of the housing 1 determines a direction of the showering jet.

The handle 2 shown in FIG. 7 is formed as a barrel-shaped cylinder with an inner opening 82, outer slots 83, and inner truncated hubs 84.

The extension element 3 shown in FIG. 8 is hollow and has a throughgoing opening 85, two grooves 86 which are limited by ring-shaped projections 87. A cylindrical portion 88 is eccentrically arranged in the gaps between them and identified in a cross-section BB as D1 with an eccentricity C1. It further has a cylindrical part 89, a flange 90 with truncated planes 91, and it ends in a threaded pipe 92.

The device is connected to a water supply system by the threaded pipe 92. Water via the opening 85 is supplied through the switching mechanism and the openings 67, 68, 69, and through these openings is supplied into one of the receptacles 24 or 73, depending on the position of the switching buttons 17 and a seal 18 which overlaps one of the openings 67 or 68. When the opening 67 is opened, water is supplied into the receptacle 73, and through the opening 81 exits as a showering flow. When the opening 68 is opened, water under pressure is supplied through the opening 69 to the vanes of the rotor 8 and rotates the rotor. The inside rotor 10 is also rotated together with the outside rotor, and has an additional force of rotation which is obtained from pressure of water that passes through the passages 27 onto the blades 32. This double rotation of two rotors creates a turbo effect which increases a force of ejection of water, which in turn increases a speed and force of rotation and also a force of pulsation.

Water in this case exits through three openings 35 located in the cover 9 as shown in FIG. 11, while the rotatable element 10 alternatingly closes the water flow through these openings so as to generate a pulsating effect. Water flows through the water distributor 12, and depending on a selected position, exits as a pulsing jet or a spray. This position is set by a user by turning of the ring 15 and together with it, of the water distributor 12. The rotating rotor through the planetary reducer, transmits rotation to the working instrument.

The device operates in two different most namely in a shower mode and in a shower plus turbo rotation mode. The switching of the modes is performed by turning of the knob 101, which turns the cam bushing 106 that interacts with the cam/hub 77, and performs a vertical displacement on the square part 104 so as to press the outside rotor 8 to the surface 114 of the element 9 as shown in FIG. 11*b* so as to stop its rotation, while the O-ring 96 closes the exit of water through the openings 34 as shown in FIG. 11*b* to tightly close the shower mode. The spring 111 performs a return of the cam bushing to an initial position when the knob 101 is turned in an opposite direction. In the moment of stopping of the outside rotor, the inside rotor continues to rotate in the cavity 94 of the rotor 8 by a stream of water that passes through the inclined openings 27 in the outside rotor 8, so as to continue expelling of water into three openings 35 to generate a pulsating effect. The water tightness of the system is carried out by rubber rings 21, 22, 23, 20 and 113.

It is therefore believed to be clear that the device can operate in several modes of operation, namely as an outside shower, as an inner shower with pulsation, as an outside and an inside shower simultaneously as a three jet pulsating stream, as an outside shower with a three jet pulsating stream, as a pulsating shower with a tube of rotation, and as a three jet pulsating stream with the turbo rotation is to be understood.

Figure 19:
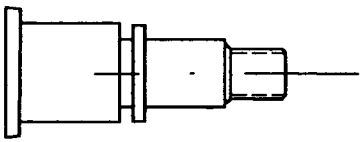
FIG. 19 is a view showing a part of switching button of the inventive device.

The control of these functions is performed by switching of a switch which is formed as a plunger composed of two rubber bushings 18 shown in FIG. 2, two buttons 17 shown in FIG. 19, one spacer 19 shown in FIG. 20. Two extreme positions of the plunger close the openings 67 and 68 and direct a stream of water into a corresponding location of outside shower or inside shower with turbo rotation, while a medium position corresponds to a water stream flowing simultaneously into two cavities so as to combine the operation of two shower systems.

Figure 1:
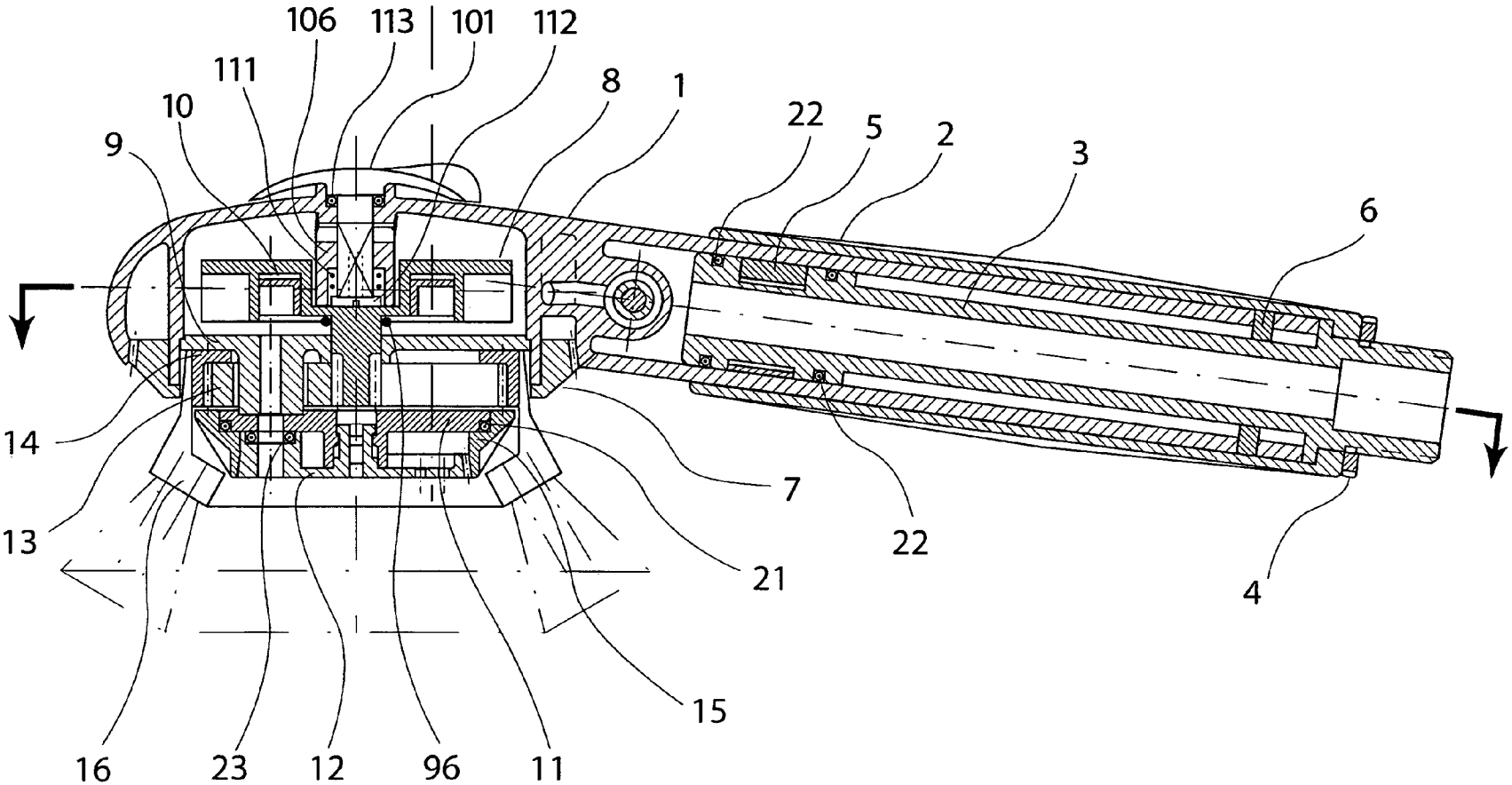
FIG. 1 is a section of side view of a device for showering in accordance with the present invention.

The switching of the pulsating shower to a pulsating jet is performed by turning of a distributor 12 shown in FIG. 1, which is located inside the ring 15.

These three systems of control are used for selection of a corresponding function and signification of the usage of the system.

A telescopic mechanism operates by turning of the handle 2, and also together with it by turning of the extension 3 in the opening 66 of the holder 63. During this process the eccentric portion 88 rotates inside the eccentric insert 5 located in the opening 66, and presses or releases the mounting, so as to fix a corresponding position of the extension element. During fixing of the extension element the outer surface of the holder 63 is pressed against the inner surface of the opening 82 of the handle 2 in the zone of the eccentric insert 5 as shown in FIG. 1 by the insert to create an additional friction. Thereby, a two sided fixation is obtained, in particular by interaction between the insert 5 and the inner surface of the holder 63 and also by interaction between the outer surface of the holder 63 and the inner surface of the handle 2.

In the present invention therefore the telescopic handle is actually composed of three elements, namely the outer handle 2, the extension element 3, and the intermediate element or the holder 63. The inner and outer elements 2, 3 are fixed to one another by the threaded ring 4 and interact with one another through the flat surfaces 84, 91, and therefore they are movable together in an axial direction and turnable together in a circumferential direction. The inserts 6 which are embedded in the intermediate element 63 allow the turning of the elements 2, 3, relative to the element 63, and at the same time form a stop when the structure composed of the elements 2, 3 is axially displaced to the right most position. It is also important that the insert 5 is located between two seals 22 to be reliably sealed from water.

It will be understood that each of the elements described above, or two or more together, may also find a useful application in other types of constructions differing from the types described above.

While the invention has been illustrated and described as embodied in device for showering, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for showering, comprising a housing having an axis; a working element arranged rotatably around said axis and capable of massaging with simultaneous discharge of water; and a rotary unit located in said housing, connected with said working element and also acted on by water, so that said rotary unit is rotated under an action of water and rotates said working element, said rotary unit including two rotors which are configured so that in a first mode of operation both said rotors rotate and provide rotation of said working element and also issuance of water for showering, and in a second mode of operation only one of said rotors rotate and said working element does not rotate and water is issued for showering with a turbo rotation of water, said rotary unit being rotatable about said axis and including an outside rotor located in a housing cavity and connected with said working element for joint rotation therewith, and an inside rotor located radially inwardly in a rotor cavity of said outside rotor and providing issuance of water for showering with the turbo rotation of water, said housing having an inlet passage through which water is supplied into said housing cavity in which said outside water rotates, said outside rotor having a plurality of blades provided therebetween with gap-shaped openings through which the water supplied into said cavity of said housing to rotate said outside rotor is further supplied into said rotor cavity to rotate said inside rotor which is located in said rotor cavity of said outside rotor.

2. A device as defined in claim 1, wherein said gap-shaped openings of said outside rotor are arranged at an angle relative to said axis of rotation.

3. A device as defined in claim 1, and further comprising means for connecting said rotors with one another for joint rotation therewith so as to provide said first mode of operation, and disconnecting said rotors from one another so as to provide said second mode of operation.

4. A device as defined in claim 1, wherein said blades of said outside rotor are located at an angle relative to said axis of rotation, and wherein said inside rotor has a plurality of blades which are located at an angle relative to said axis of rotation.

5. A device as defined in claim 4, wherein said inlet passage of said housing is arranged at an angle relative to said axis of rotation.

6. A device as defined in claim 5, wherein a supply passage is provided in said housing, said supply passage is a single passage which supplies water from outside into said rotary unit to provide a water flow into said housing cavity and then through said gap-shaped openings into said rotor cavity.

7. A device as defined in claim 1, wherein outside rotor is axially displaceable relative to said inside rotor to stop the rotation of said outside rotor, while said inside rotor continues to rotate by the water passing through said gap-shaped openings of said outside rotor.

* * * * *